United States Patent [19]

Hopkins

[11] 3,963,202

[45] June 15, 1976

[54] GRADE-CROSSING MOTORIST WARNING SYSTEM

[75] Inventor: John B. Hopkins, Cambridge, Mass.

[73] Assignee: The United States of America as represented by the Secretary of the Department of Transportation, Washington, D.C.

[22] Filed: Mar. 3, 1975

[21] Appl. No.: 555,021

[52] U.S. Cl. ..... 246/125; 246/293; 340/47

[51] Int. Cl.[2] ..... B61L 29/28

[58] Field of Search ..... 246/125, 111, 113, 260, 246/292, 293, 294, 473, 477; 315/130, 131, 132, 133; 340/47, 49, 212, 81 R, 83, 331, 332

[56] References Cited

UNITED STATES PATENTS

| | | | |
|---|---|---|---|
| 2,679,635 | 5/1954 | Hart | 340/83 |
| 3,205,478 | 9/1965 | Scheg | 246/125 |
| 3,444,512 | 5/1969 | Reinitz | 340/47 |

OTHER PUBLICATIONS

Railway Signalling, Dec. 1940, "Gates, Signals and Traffic Lights at a Wabash Crossing".

*Primary Examiner*—Stephen G. Kunin
*Assistant Examiner*—Reinhard J. Eisenzopf
*Attorney, Agent, or Firm*—Herbert E. Farmer; Harold P. Deeley, Jr.

[57] ABSTRACT

A railroad-highway grade-crossing warning system is accomplished by control circuitry for synchronizing the flash rates of incandescent and xenon lamps so as to produce a continuously uniform signal pattern which can be rapidly identified and understood by a motorist.

5 Claims, 2 Drawing Figures

GRADE-CROSSING MOTORIST WARNING SYSTEM

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

This invention relates generally to railroad-highway grade crossing signaling systems and, more particularly, to such a system employing sychronized sets of flashing incandescent and xenon lamps.

The basic train-activated flashing lights now found at many railroad-highway grade crossings, either alone or in conjunction with automatic gates, have been in use for over 50 years. Although many improvements have occurred in both performance and construction, the aspect presented to the motorist has become well standardized: two incandescent lamps, mounted in reflectors behind red lenses, horizontally aligned at a spacing of 30 inches (0.76 m), against a 20-inch (0.5 m) circular black background, flashed alternately at a rate of 35 to 55 flashes per minute for each lamp. Indeed, the history of this basic pattern can be traced back through the electromechanical wig-wag signal to the motion of a man swinging a red lantern.

Such warnings have generally been found to reduce the occurrence of grade crossing accidents by 60% to 80%. They are now to be found at an estimated 41,600 of the 223,300 public crossings in the United States, accompanied by automatic gates in approximately 9000 cases. Through the years, the railroad supply industry advanced the technology of these lights substantially, particularly in recent times. In addition to improved mountings and reflectors, lenses incorporating more efficient beam patterns and fabricated from nearly-unbreakable polycarbonate materials have been developed. Higher intensity bulbs are now offered, with special reflectorization available, and quartz-halogen lamps are now on the market along with 12-inch (0.3 m) assemblies [compared to the standard 8⅜ inch (0.2 m) size].

These changes have generally contributed to greater brightness and improved beam patterns. However, all have occurred within a framework which has severely limited major innovation. Perhaps the most fundamental limitation on conventional warnings is the very low power consumption permitted. It is generally considered necessary (and legally required) that grade crossing protective systems operate from batteries for periods of one to seven days in the event of any failure of commercial power or power system components (such as fuses). This constraint, coupled with the large number of lights commonly used at a crossing (typically four pairs; often three or four times that) led to use of 11-watt bulbs for many years, with 18 watts now standard and 25 watts coming into wide usage. When these figures are compared to the 60 to 150-watt ratings of bulbs used in highway traffic signals, it becomes obvious that adequate intensity can be obtained only through tight focusing of the lights to a narrow beam. This is the course which has been followed, with special roundel design providing a diversion of a limited quantity of light in certain directions to include motorists not located within the main beam. This limitation has been exacerbated by the use of a very deep shade of red, which attenuates light output by approximately 90%. However, the modern use of plastic lenses now permits use of a substantially lighter shade; much tighter manufacturing tolerances are possible than is the case for glass, so roundels can be produced at the lighter limit of existing standards.

Considered in terms of effectiveness as a motorist warning device, serious limitations arise from this technical constraint. The problems are both inherent and practical. In the former category is the challenge of providing an adequately intense light to all positions which a motorist might occupy. Even the use of two or three pairs of lamps, aimed to provide overlapping coverage of the entire approach path, often appears to be marginally adequate. Further, a driver might easily focus his attention upon a pair of lights other than the one appropriate to his position, and be inadequately warned. This difficulty has tended to increase in recent years, as lights have been located further from the road — both vertically (with cantilevers) and horizontally (beyond highway shoulders). This difficulty is a primary cause of the common (but incorrect) impression that grade crossing lights are inherently less bright than conventional highway traffic signals.

Of comparable importance in practice is the great sensitivity of such a device to misalignment. Whether through misplacement of the bulb, faulty aiming of the assembly, use of an appropriate roundel, or physical movement through accident or malicious vandalism, very little deviation is required to degrade seriously the effectiveness of the warning. The railroad environment is one which makes particularly difficult the attainment and maintenance of optimal conditions. Extremes of weather, continual vibration, sabotage, etc., all make probable that at any given time the lights will deviate somewhat from proper aim.

Thus, one of the fundamental quantitative specifications needed for warning lights is intensity. This is not a simple matter. The brightness required for "adequate" warning depends upon the individual's physical and emotional characteristics, the ambient light level, and the entire visual context. One common criterion for brightness is that the source intensity $I_o$ (candela) appropriate to a viewing distance $d$ (ft), with ambient illuminance $L_b$ (ft-Lamberts), is given by the expression $$I_o = 6.37\,(L_B + 2.92)\,d^2 \times 10^{-7}\ \text{(cd)}$$

As an example, "normal daytime conditions" ($L_b$ = 2919 ft-L, or 10,000 cd/m$^2$) imply $I_o$ = 200 cd to be necessary for a viewing distance of 330 ft. (100 m). Background illuminance can, at times, reach three to four times this value. Further, the intensity required if one seeks to alert as well as inform can increase this value. However, this equation provides a useful starting point, and is readily modified if necessary. (Under night conditions, it is important that intensity not be so great that motorists are bothered or hampered in their actions. Tests in a different but related research activity indicate that a level of 200 to 500 cd is likely to be acceptable for an observer 20 to 50 ft. (6 to 15 m) from the lights.)

A given amount of radiant energy can be utilized as a short, high-intensity flash or a longer pulse at reduced intensity. This suggests the desirability of using very short, very intense pulses in cases for which power efficiency is important. However, the perceived brightness of flashes which are markedly shorter than the response time of the eye (~0.1 sec) is basically determined by total flash energy alone, so that no further benefits are obtained for shorter flashes. Numerous studies of this very complex topic confirm that the power efficiency with which a given perceived brightness level can be obtained increases with decreasing duration, down to approximately 0.1 sec; little improvement is found below that interval.

The key then to synthesis of a meaningful advance in railroad crossing signals is the requirement for a short flash duration. Since it is not practical to cycle an incandescent bulb at the pulse durations desired, due to filament heating and cooling times, an alternative is needed. Electromechanical devices, such as rotating beacons, can provide the desired effect. However, considerations of cost, complexity, and maintenance requirements, as well as synchronization and easy adaptation to existing systems, all combine to make this approach impractical.

A more promising approach was disclosed in U.S. Pat. No. 3,390,304 and entails the use of xenon flashtube (capacitive discharge) lamps. In such lights, the energy stored in a capacitor ($\frac{1}{2}CV^2$) is released - primarily as visible radiation - by electrical discharge across a xenon-filled gap. The process is readily initiated by an applied "trigger" signal, so that precise timing and synchronization is possible; duration is typically less than 0.001 sec. However, since familiarity is such an important criterion in signaling, the mere substitution of xenon lamp systems for the presently employed incandescent lamp systems would not be prudent. With this factor in mind, xenon lights have been added to conventional flashers in a variety of forms at operating grade crossings. Although generally providing good results, this approach fostered a new concern. The quasi-random pattern produced by asynchronous pairs of xenon and incandescent lamps can be quite attention-getting at some times, but raises serious questions in a motorist warning system wherein uniformity of aspect is a key to rapid identification and understanding on the part of vehicle operations. Such uniformity can be achieved only through assuring that the perceived pattern is the same every time it is encountered.

The object of this invention, therefore, is to establish a more effective signaling system for use at railroad grade crossings.

SUMMARY OF THE INVENTION

The present invention is a railroad-highway grade crossing warning system employing a pair of incandescent lamps mounted so as to be visible to a motorist approaching a crossing and a control circuit for alternately energizing each of the lamps at a rate of between 30 and 60 times per minute. Mounted in juxtaposition on the incandescent lamps is a pair of xenon lamps also visible to the approaching motorist. The xenon lamps are alternately triggered by a synchronized control circuit at a rate of two to four times that used for the incandescent lamps. The xenon lamps provide signals of greater alerting effectiveness than do the conventional incandescent lamps and therefore are more readily visible to the approaching motorist, while the synchronization circuit assures that the perceived signal pattern produced by both the incandescent and xenon lamps will be continuously uniform which is the key to rapid identification and understanding by the approaching motorist.

In a preferred embodiment of the invention, the system includes an additional trouble lamp that is energized to indicate the absence of an approaching train. In addition to warning the motorist of the presence of the crossing, which otherwise might not be noticed, an energized trouble lamp apprises the motorist that the warning system is operational while a de-energized trouble lamp indicates an inoperating system and warns the motorist to approach the crossing with caution even in the absence of a train approach signal.

DESCRIPTION OF THE DRAWINGS

These and other objects and features of the present invention will become apparent upon a perusal of the following description taken in conjunction with the accompanying drawings wherein.

DESCRIPTION OF THE PREFERRED EMBODIMENT

Figure 1:
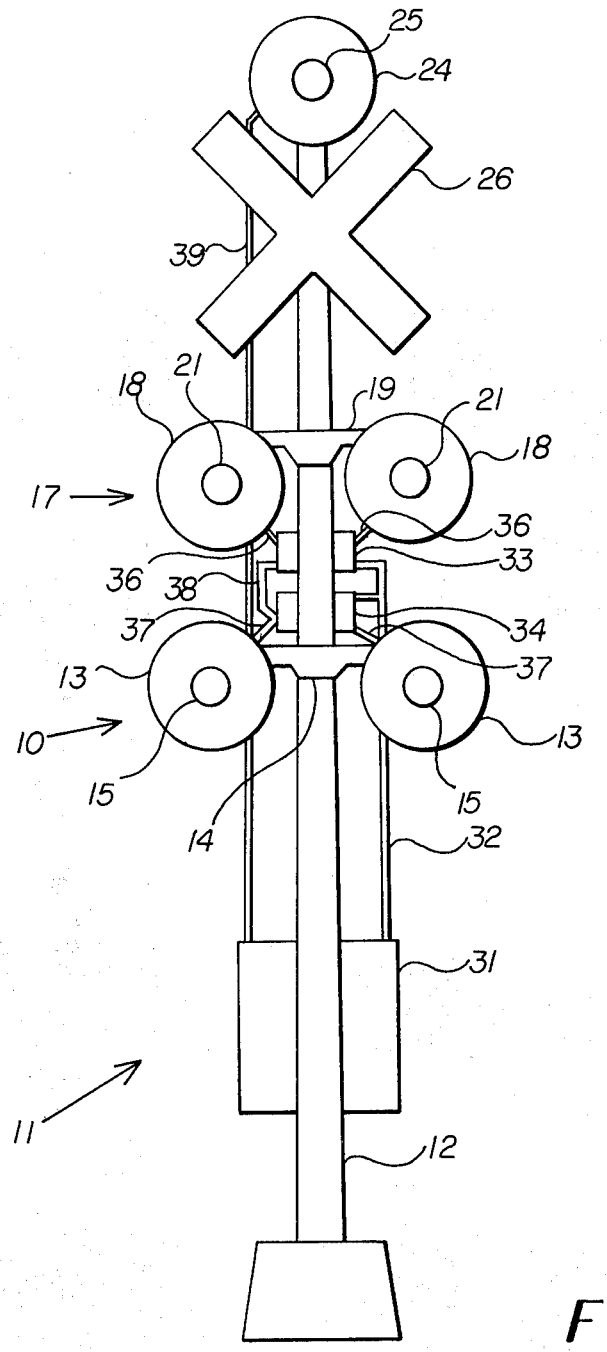
FIG. 1 is a schematic view of a railroad-highway grade crossing signaling system of the invention.

Referring now to FIG. 1 there is schematically shown a warning system 11 constructed in accordance with the present invention. Supporting the system 11 is a vertical post 12 that would be located in the immediate vicinity of a railroad-highway grade crossing. Included in the system is a primary warning assembly 10 comprising a pair of housings 13 mounted on the post 12, one at each end of a horizontal mounting bracket assembly 14. Behind a red lens 15 in each of the housings 13 is a conventional incandescent lamp 16 (FIG. 2) of the type conventionally used with such equipment. An auxiliary signaling system 17 also is mounted on the post 12 directly above the primary assembly 10. Included in the auxiliary assembly 17 are a pair of housings 18, one mounted on each end of a horizontal support bracket 19 and each retaining a red lens 21. Behind each of the lenses 21 is a xenon flash tube 22 (FIG. 2) that provides a high intensity flash in response to discharge of the stored energy from a capacitor through a xenon-filled gap. Mounted at the top of the post 12 in a housing 24 is a trouble lamp 25. A commonly recognized railroad crossing sign 26 is mounted on the post 12 between the trouble light 25 and the auxiliary warning assembly 17. It will be appreciated that the assemblies 10, 17 and 24 are oriented so that the lamps 16, 22 and 25 will be readily visible to operators of vehicles approaching the crossing.

Mounted at the base of the post 12 is a control box 31 that houses control circuitry and a power supply for the system 11. An electrical cable 32 provides electrical connection between the control box 31 and a pair of circuit housings 33 and 34 mounted on the post 12 between the primary assembly 10 and the auxiliary assembly 17. The circuits in the housing 33 provide control signals to the xenon lamps 22 via electrical cables 36 while the circuits in the housing 34 supply both energizing signals to the incandescent lamps 16 via electrical cables 37 and a synchronization signal on cable 38 to the xenon control circuits in the housing 33. Also supplied by a cable 39 is an energizing signal for the trouble lamp 25 from the control box 31.

Figure 2:
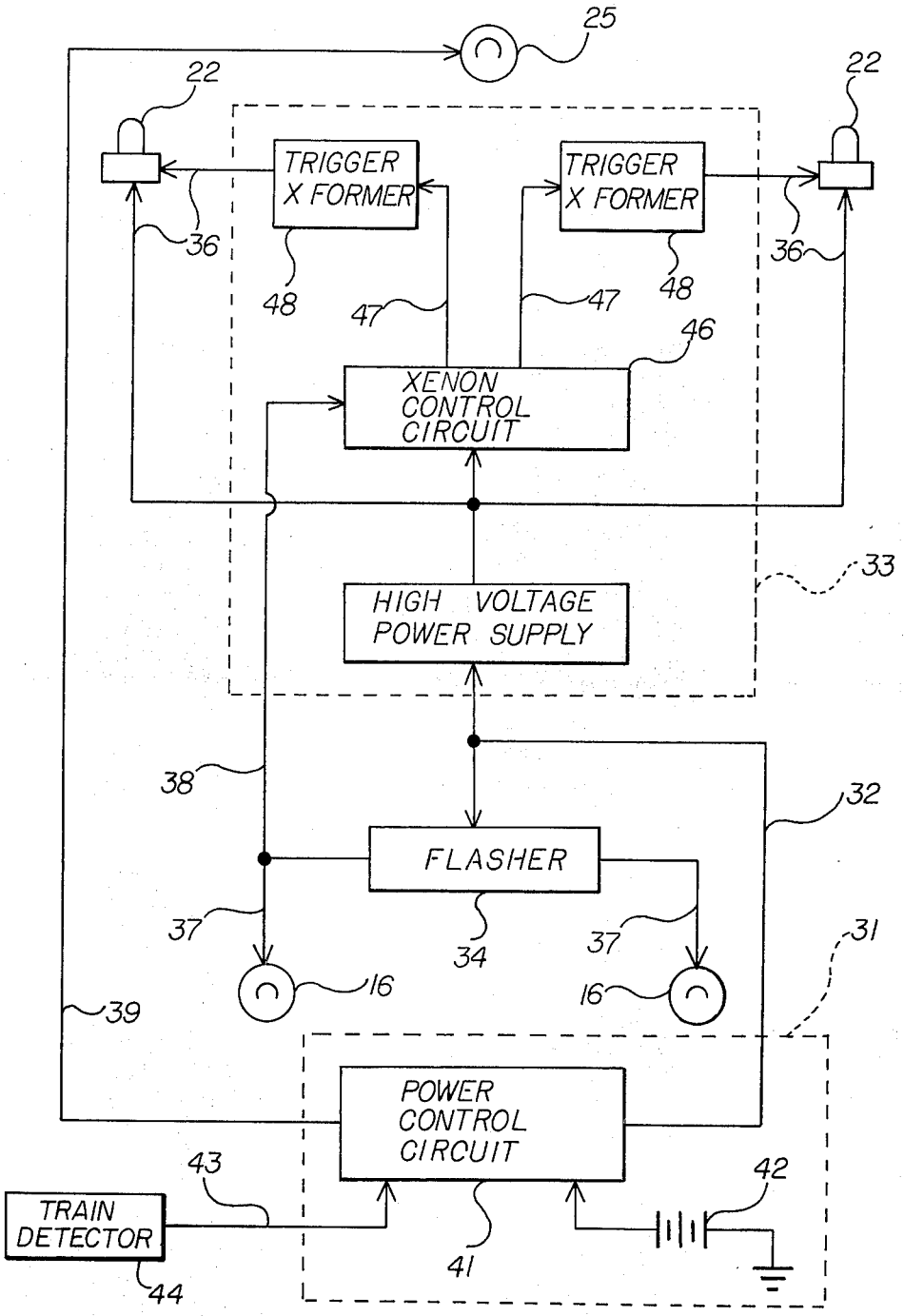
FIG. 2 is a schematic block diagram of the electrical control circuit utilized in the system of FIG. 1.

Referring now to FIG. 2 there is shown in block diagram form the control circuitry for the system 11. A power control circuit 41 within the control box 31 includes a conventional power conditoner for a power supply 42, for example, a nominal 12-volt DC supply. Also included in the circuit 41 is a relay switch that responds to a crossing signal on a line 43 to alternately provide an energizing signal on either the line 32 or the line 39. The crossing signal on line 43 is received from a conventional train approach detector 44 of the type, for example, disclosed in U.S. Pat. No. 3,205,478. Controlled by the output of the circuit 41 on line 32 is a conventional flasher circuit 34 that alternately energizes via lines 37 each of the incandescent lamps 16 at a repetition rate of between 45 and 60 flashes per minute.

Included in the enclosure 33 is a high voltage power supply 45 that receives power from the circuit 41 on line 32 and supplies power to both a xenon control circuit 46 and the xenon lamps 22. Also received by the xenon control circuit 46 on line 38 is a synchronizaton signal from the flasher 34. The xenon control circuit 46 responds to the synchronization signal on line 38 by alternately supplying on lines 47 control pulses to a pair of trigger transformers 48 which in turn provide trigger pulses to the xenon lamps 22. Preferably, each of the transformers 48 are triggered at a rate of between 2, 3 or 4 times the rate established by the flasher 34 for each of the incandescent lamps 16.

In response to a signal on line 43 indicating the approach of a train to the crossing, the circuit 41 produces an output on line 32 that activates the flasher 34 and the xenon control circuit 46. The resultant periodic energization of both the incandescent lamps 16 and the xenon lamps 22 produces a visible warning to motorists that a train is approaching. Because of the synchronized flash rates provided for the two pairs of signal lights, the combined signal pattern observed by an approaching motorist is always uniform and thereby promotes rapid identification and understanding.

In the absence of a train approach signal on line 43, the circuit 41 supplies power on line 39 to energize the trouble lamp 25. This informs a motorist that an approaching train has not been detected. Furthermore, the energized lamp 25 indicates that the warning system 11 is operational. In this way another shortcoming of conventional railroad-highway crossing warning lights is obviated.

The signals at highway intersections are generally referred to as traffic control devices. It is reasonable to assume that motorists in general perceive that an intersection is ahead, that hazard exists, and that it is prudent to seek to ascertain the presence of either active or passive traffic control devices. Active warnings generally proclaim their presence by a flashing or continuous light. None of these factors can be assumed at a conventional grade crossing. The presence of a railroad-highway intersection may not be noted until it is quite close, and the situation may be poorly understood. Indeed, studies have shown that many motorists have a highly imperfect knowledge concerning grade crossings, and sometimes make unwarranted and dangerous assumptions. Thus, the function of the active trouble light 25 is to alert the motorist to a potentially very hazardous situation which requires his careful attention. When it is not activated, due to a malfunction, the crossing has the basic appearance of a passively-protected installation, which is appropriate to its functional capabilities.

Obviously, many modifications and variations of the present invention are possible in light of the above teachings. It is to be understood, therefore, that the invention can be practiced otherwise than as specifically described.

What is claimed is:

1. A railroad-highway crossing warning system comprising:

support means for location near a crossing;

a primary warning system mounted on said support means and comprising a pair of incandescent lamp means oriented so as to be visible to a vehicle operator approaching the crossing;

incandescent lamp control means for periodically energizing each of said incandescent lamp means at a given rate;

an auxiliary warning system mounted on said support means and comprising a pair of xenon lamp means oriented so as to be simultaneously visible with said incandescent lamps to the same operator;

xenon control means for periodically energizing each of said xenon lamp means at a predetermined rate;

synchronization means for synchronizing said given and predetermined rates; and train detector means for producing a train-presence signal to activate said incandescent lamp control means and said xenon control means in response to approach of a train to the crossing.

2. A system according to claim 1 including a trouble light means mounted on said support means and oriented so as to be visible to the same operator, and trouble control means for energizing said trouble light in response to failure of said detector means to produce said train-presence signal in the absence of a train approaching the crossing.

3. A system according to claim 2 wherein said incandescent lamp means comprises a pair of incandescent lamps, each alternately energized by said incandescent lamp control means at said given rate; and said xenon lamp means comprises a pair of xenon lamps, each alternately energized by said xenon control means at said predetermined rate.

4. A system according to claim 3 wherein said predetermined rate is greater than said given rate.

5. A system according to claim 4 wherein said given rate is in a range between 30 and 60 per minute, and said predetermined rate is two to four times said given rate.

* * * * *